US012439977B2

(12) United States Patent
Hutchens

(10) Patent No.: US 12,439,977 B2
(45) Date of Patent: Oct. 14, 2025

(54) NO-SLIP SOCK CONSTRUCTIONS

(71) Applicant: Summer Hutchens, Lowell, NC (US)

(72) Inventor: Summer Hutchens, Lowell, NC (US)

( * ) Notice: Subject to any disclaimer, the term of this patent is extended or adjusted under 35 U.S.C. 154(b) by 0 days.

(21) Appl. No.: 18/313,524

(22) Filed: May 8, 2023

(65) Prior Publication Data

US 2023/0354923 A1 Nov. 9, 2023

Related U.S. Application Data

(60) Provisional application No. 63/339,646, filed on May 9, 2022.

(51) Int. Cl.
*A41B 11/00* (2006.01)
*A43B 13/36* (2006.01)

(52) U.S. Cl.
CPC ..... *A41B 11/007* (2013.01); *A41B 11/008* (2013.01); *A43B 13/36* (2013.01)

(58) Field of Classification Search
CPC ..... A41B 11/007; A41B 11/008; A43B 3/246; A43B 3/16; A43B 13/36; A43B 13/26; A43B 13/16; A43B 5/02; A43B 5/025; A43B 23/07; A43B 23/28; A43B 17/18
See application file for complete search history.

(56) References Cited

U.S. PATENT DOCUMENTS 4,393,604 A * 7/1983 Crowley ..... A43C 15/162 36/126
4,896,438 A * 1/1990 DeBease ..... A43B 3/16 36/73
5,092,347 A * 3/1992 Shaffer ..... A61F 13/064 128/892
5,367,791 A * 11/1994 Gross ..... A43B 13/26 36/31
6,138,281 A * 10/2000 Chiaruttini ..... A41B 11/02 2/239
7,140,129 B2 * 11/2006 Newson ..... A43B 3/244 36/3 R
9,486,036 B1 * 11/2016 Douglas ..... A43B 23/0245
2002/0178620 A1 * 12/2002 Asciolla ..... A43B 13/36 36/15
2005/0066544 A1 * 3/2005 Beak ..... A43B 17/18 36/43
2007/0271819 A1 * 11/2007 Chen ..... A43B 1/0081 36/43
2009/0183392 A1 * 7/2009 Shane ..... A43B 3/244 12/114.2
2011/0192056 A1 * 8/2011 Geser ..... A43B 13/26 36/114

(Continued)

*Primary Examiner* — Patrick J. Lynch
(74) *Attorney, Agent, or Firm* — Troutman Pepper Locke LLP; John Morrissett; Celeste K. Walker

(57) ABSTRACT

A no-slip sock construction may include a sock and a shoe insert. The sock may include one or more first components and one or more second components, each positioned on an outside bottom surface of the sock. The one or more first components may include a no-slip material, and the one or more second components may each include one or more loop fasteners. The shoe insert may include one or more hook fasteners configured to interconnect with the one or more loop fasteners, and one or more openings configured to slidably receive at least a portion of the one or more first components.

20 Claims, 2 Drawing Sheets

(56) References Cited

U.S. PATENT DOCUMENTS

| | | | | |
|---|---|---|---|---|
| 2012/0330795 | A1* | 12/2012 | Hayes | A43B 7/1464 705/28 |
| 2016/0021981 | A1* | 1/2016 | Sanchez | A43C 15/02 36/114 |
| 2017/0231321 | A1* | 8/2017 | Tremblay | A43B 1/0045 36/93 |
| 2018/0255863 | A1* | 9/2018 | Kuo | A43B 1/04 |
| 2020/0260817 | A1* | 8/2020 | Kapoor | A43C 11/004 |
| 2023/0404211 | A1* | 12/2023 | Cavaliere | A43B 17/18 |

* cited by examiner

NO-SLIP SOCK CONSTRUCTIONS

CROSS-REFERENCE TO RELATED APPLICATIONS

This application claims priority under 35 U.S.C. § 119 to U.S. Provisional Patent Application No. 63/339,646, filed May 9, 2022, the entire contents of which are fully incorporated herein by reference.

FIELD

The disclosed technology generally relates to no-slip sock constructions, and more particularly to sock constructions having no-slip components configured to interconnect with complementary components in shoe sole inserts.

BACKGROUND

Children in particular often have difficulty keeping socks and shoes fastened securely on their feet. When children lose their shoes—whether intentionally or unintentionally—the children are typically left running around in socks made from slippery materials, such as cotton, polyester, nylon, and the like. Some traditional sock constructions designed with no-slip or grippy materials may help children from slipping on certain surfaces, for example, hardwood flooring. However, these no-slip materials do not provide sufficient interconnectivity with shoe insoles such that children can easily keep their shoes fastened to their feet. Traditional no-slip materials also often sit on the surface of the socks themselves, causing discomfort when placed inside shoes as the socks may not sit flush with the shoe insoles.

Accordingly, there is a need for improved no-slip sock constructions. Embodiments of the present disclosure are directed to this and other considerations.

SUMMARY

Disclosed embodiments may include a system for a no-slip sock construction. The system may include a sock and a shoe insert, where the shoe insert may be removeable such that it may be used as an insole in a variety of standard shoes. The sock may include one or more first components and one or more second components each positioned on an outside bottom surface of the sock. The one or more first components may each include a no-slip material, such as silicone. The one or more second components may each include one or more loop fasteners, such as those included on the soft side of VELCRO®.

In some embodiments, the one or more first components and the one or more second components may be positioned in an alternating pattern along one or more sections of the outside bottom sock surface, such as on the ball or heel of the sock.

The shoe insert may include one or more hook fasteners, such as those included on the rough side of VELCRO®, configured to interconnect with the one or more loop fasteners of each of the one or more second components of the sock when the sock and shoe insert are pressed flush against one another (e.g., when a person wearing the sock steps into a shoe with the shoe insert placed inside). The shoe insert may further include one or more openings configured to slidably receive at least a portion of the one or more first components of the sock when the sock and shoe insert are pressed flush against one another.

Disclosed embodiments may include a system for a no-slip sock construction. The system may include a sock, a first shoe insert, and a second shoe insert. The sock may include one or more first components positioned on a first outside surface of the sock (e.g., a bottom surface), and one or more second components positioned on a second outside surface of the sock (e.g., a heel or ankle portion). Each of the one or more first and second components may include one or more loop fasteners, such as those included on the soft side of VELCRO®. The first shoe insert may include one or more first hook fasteners configured to interconnect with the one or more loop fasteners of the one or more first components. The second shoe insert may include one or more second hook fasteners configured to interconnect with the one or more loop fasteners of the one or more second components.

Further implementations, features, and aspects of the disclosed technology, and the advantages offered thereby, are described in greater detail hereinafter, and can be understood with reference to the following detailed description, accompanying drawings, and claims.

BRIEF DESCRIPTION OF THE DRAWINGS

Reference will now be made to the accompanying drawings, which are not necessarily drawn to scale, and which illustrate various implementations, aspects, and principles of the disclosed technology. In the drawings.

DETAILED DESCRIPTION

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed devices and methods. Such other components not described herein may include, but are not limited to, for example, components developed after development of the disclosed technology.

Reference will now be made in detail to exemplary embodiments of the disclosed technology, examples of which are illustrated in the accompanying drawings and disclosed herein. Wherever convenient, the same references numbers will be used throughout the drawings to refer to the same or like parts.

Figure 1:
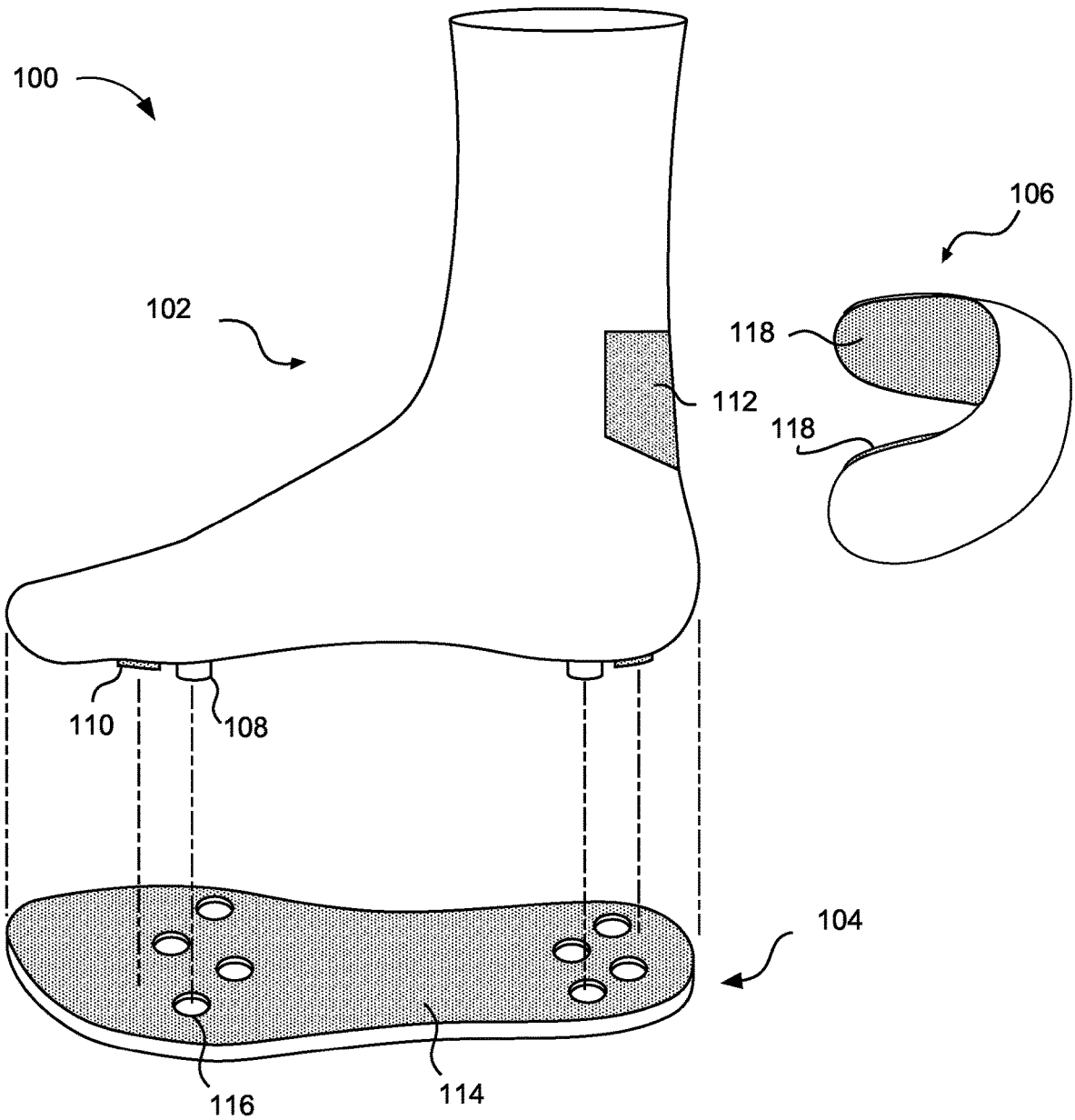
FIG. 1 is a perspective view of a no-slip sock construction according to certain embodiments of the present disclosure.

FIG. 1 provides a perspective view of a no-slip sock construction 100 including a sock 102, a complementary first shoe insert 104, and a complementary second shoe insert 106. Sock 102 may be made of any typical sock material, such as cotton, polyester, nylon, and the like. Sock 102 may include one or more first components 108 positioned on the outside bottom surface of sock 102. First components 108 may each include a no-slip or grippy material, such as silicone, a non-slip rubber (e.g., neoprene), vinyl, polyethylene, urethane, cork, etc. Sock 102 may include one or more second components 110 positioned on the outside bottom surface of sock 102. The one or more second components 110 may each include one or more loop fasteners, for example, the soft side of VELCRO®, or one or more hook fasteners, for example, the rough side of VELCRO®. Whether second components 110 include loop or hook fastener(s) may depend on the type of ground surface upon which a shoe, including no-slip sock construction 100, is worn, as further discussed below. Sock 102 may include one or more third components 112 positioned on another outside surface of sock 102, such as the ankle or heel portion of sock 102. The one or more third components 112 may each include one or more loop fasteners, for example, the soft side of VELCRO®, or one or more hook fasteners, for example, the rough side of VELCRO®. Whether third components 112 include loop or hook fastener(s) may depend on the type of material included on the second shoe insert 106, as further discussed below.

In some embodiments, first components 108 may each have a thickness of approximately 0.25 to approximately 0.5 inches. That is, first components 108 may each extend outward from the outside bottom surface of sock 102 by approximately 0.25 to 0.5 inches. In some embodiments, first components 108 may be configured to outwardly extend farther from the outside bottom surface of sock 102 than the second components 110. This configuration may help to avoid slipping on smooth or shiny surfaces (e.g., hardwood, tile, etc.), particularly when second components 110 include loop fasteners, as discussed herein.

In some embodiments, first components 108, second components 110, and third components 112 may each be configured as one or more shapes. For example, first components 108 may be configured to have a circular shape with a diameter of approximately 0.39 inches (approximately 1.0 centimeters), as particularly illustrated in FIG. 2. Second components 110 may be configured to have a square shape, each side having a length of approximately 0.20 inches (approximately 0.5 centimeters), as particularly illustrated in FIG. 2. Third components 112 may be configured to have varying shapes and/or sizes, as shown in FIG. 1.

First shoe insert 104 may include one or more hook fasteners 114, for example, the rough side of VELCRO®, or one or more loop fasteners, for example, the soft side of VELCRO®, disposed along a first side of the first shoe insert 104. In some embodiments, as shown in FIG. 1, hook fasteners 114 (or loop fasteners) may include the entire top surface of first shoe insert 104, with the exception of one or more openings 116, as further described below. Hook fasteners 114 may be configured to interconnect with the one or more loop fasteners of second components 110 of sock 102 (or vice versa), as particularly illustrated in FIG. 1. That is, when sock 102 and first shoe insert 104 are pressed flush against one another, e.g., when a person wearing sock 102 steps into a shoe with first shoe insert 104 placed inside, hook fasteners 114 of first shoe insert 104 and one or more loop fasteners of second components 110 of sock 102 may interconnect and sit flush against one another. In some embodiments where second components 110 include hook fasteners, as discussed above, first shoe insert 104 may include loop fasteners rather than hook fasteners 114 such that sock 102 and first shoe insert 104 may still interconnect and sit flush against one another. Such embodiments may operate best on ground surfaces that do not have carpeting or other soft materials that may attach to sock 102 if worn by itself, e.g., if a child kicks off his/her shoe and is walking or running around wearing only sock 102. In such embodiments, there may be a reduced need for including first components 108 on sock 102 and/or complementary openings 116 on first shoe insert 104, as further discussed below, as second components 110 including hook fasteners may provide sufficient enough support and traction when sock 102 is worn on smooth surfaces (e.g., hardwood, tile, etc.). In such embodiments, it may be advantageous to include additional second components 110 on other areas of the outside bottom surface of sock 102, as further discussed below, to further enhance support and traction of sock 102.

First shoe insert 104 may further include one or more openings 116 configured to interconnect with first components 108, such that when sock 102 and first shoe insert 104 are pressed flush against one another, openings 116 are configured to accept at least a portion of first components 108, as particularly illustrated in FIG. 1. As discussed above, first components 108 may extend further outward from the outside bottom surface of sock 102 compared to second components 110. In such embodiments, in order for sock 102 and first shoe insert 104 to sit flush against one another, first components 108 may fit down inside openings 116, while second components 110 may be simultaneously pressed flush against hook fasteners 114. A benefit of this feature is that when worn together, sock 102 and first shoe insert 104 may sit comfortably flush against one another, and help to ensure a shoe including first shoe insert 104 could not be easily kicked off, for example, by a young child.

To ensure sock 102 and first shoe insert 104 sit comfortably flush against one another, first shoe insert 104 may be attached to sock 102 prior to a wearer (e.g., a child) putting his/her foot into a sock 102. Alternatively, a wearer may first put on the sock 102, then attach first shoe insert 104 to the sock 102, and then place his/her foot inside a shoe. In these ways, one (e.g., a parent) can be sure the sock 102 and first shoe insert 104 are pressed flush against one another, with openings 116 fully accepting first components 108.

In some embodiments, first shoe insert 104 may be configured to be removable such that it may be placed inside and taken out of a variety of shoe types. For example, a parent may wish to use a single first shoe insert 104 in multiple pairs of shoes worn by a child, such as sneakers, boots, slippers, etc., such that the child has an easier time keeping any style of his/her shoes on his/her feet. In some embodiments, first shoe insert 104 may be configured to have an adhesive backing (e.g., plastic film, paper, fabric, vinyl, etc.) on its bottom surface such that first shoe insert 104 may more easily adhere to the insole of a shoe.

Figure 2:
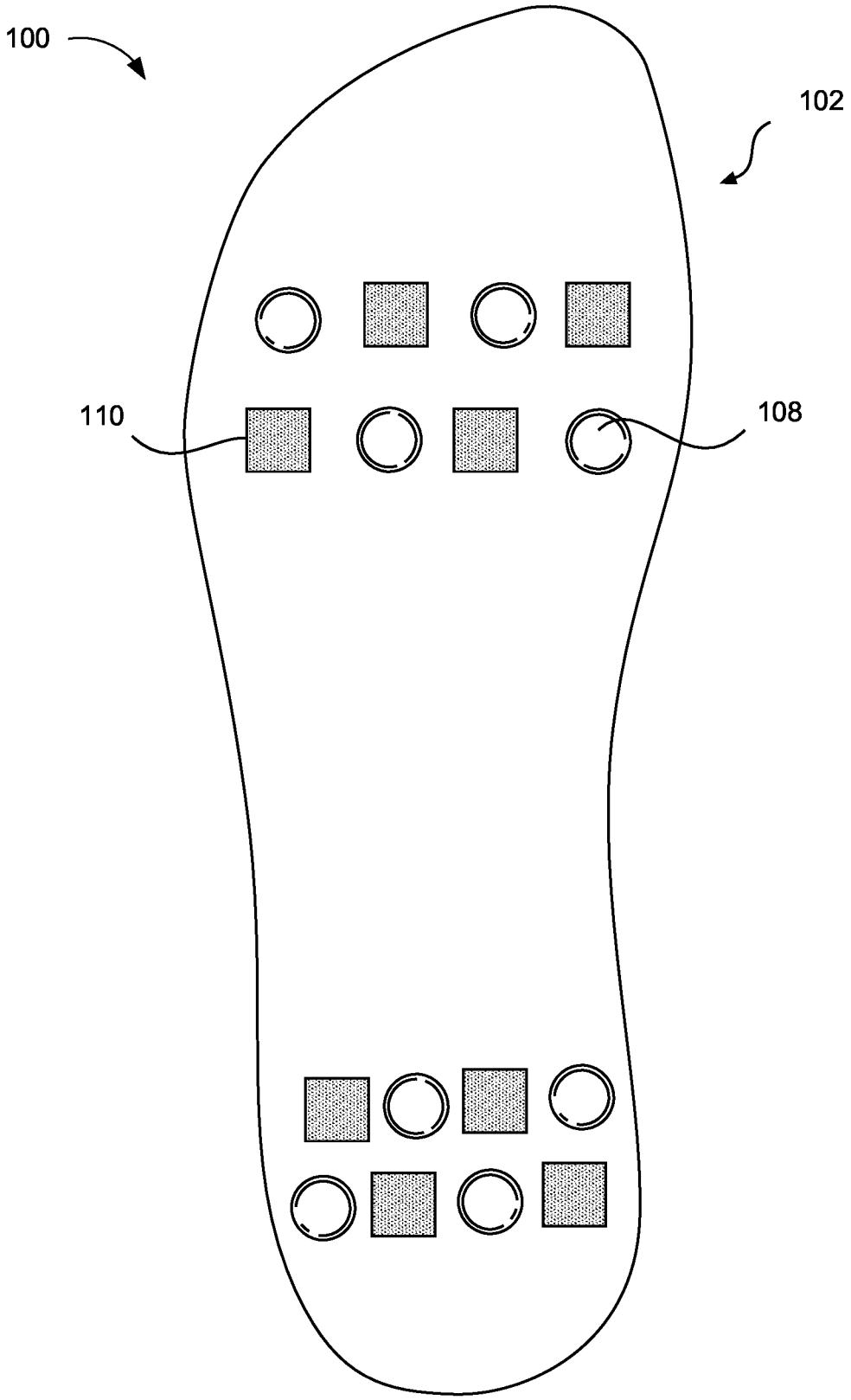
FIG. 2 is a perspective view of an outside bottom surface of a sock as part of a no-slip sock construction according to certain embodiments of the present disclosure.

In some embodiments, as shown in FIG. 2, first components 108 and second components 110 may be positioned in an alternating pattern. This alternating pattern may be disposed on one or more sections of the outside bottom surface of sock 102, such as on the heel or the ball of the foot. This type of alternating pattern provides an added benefit in that sock 102 may fit more evenly, and thus more comfortably, inside a shoe and against first shoe insert 104. Another benefit of this alternating pattern is that in the event a person, such as a young child, does manage to kick off or lose his/her shoe, and is still wearing sock 102, the alternating pattern of first components 108 and second components 110 may still enable the child to walk safely on any type of surface. That is, first components 108—when including a no-slip material and extending farther outward from the outside bottom surface of sock 102 compared to second components 110—may help to ensure sock 102 will not be slippery if worn across smooth surfaces, such as hardwood or laminate flooring. At the same time, second components 110—when including soft loop fasteners—may not cling to or grip softer or fuzzier surfaces, such as carpeting.

In some embodiments, first components 108 and second components 110 may form any kind of design or pattern on the outside bottom surface of sock 102, including any number of first components 108 and/or second components 110. For example, additional first components 108 and/or second components 110 (e.g., compared to those shown in FIG. 2) may be added to the outside bottom surface of sock 102, such as to the ball and/or arch of the foot, and shaped to match the shape of the foot in those areas. Adding extra first components 108 may provide added protection against slipping on smooth surfaces, while adding extra second components 110 may help ensure sock 102 and first shoe insert 104 fit securely together, as discussed above.

Turning back to FIG. 1, second shoe insert 106 may be configured as a flexible material (e.g., a foam or gel) such that it may be molded and/or positioned along the inside heel or ankle portion of a shoe. In some embodiments, second shoe insert 106 may be configured to have an adhesive backing (e.g., plastic film, paper, fabric, vinyl, etc.) on its outside surface such that second shoe insert 106 may more easily adhere to the inside ankle or heel portion of a shoe.

As discussed above with respect to first shoe insert 104, second shoe insert 106 may include one or more hook fasteners 118, for example, the rough side of VELCRO®, or one or more loop fasteners, for example, the soft side of VELCRO®, disposed along a first side of the second shoe insert 106. In some embodiments, as shown in FIG. 1, hook fasteners 118 (or loop fasteners) may be disposed along the entire inner surface of second shoe insert 106, such that hook fasteners 118 may interconnect with the one or more loop fasteners of third components 112 of sock 102 (or vice versa), as particularly illustrated in FIG. 1. That is, when sock 102 and second shoe insert 106 are pressed flush against one another, e.g., when a person wearing sock 102 steps into a shoe with second shoe insert 106 placed inside the heel or ankle area, hook fasteners 118 of second shoe insert 106 and one or more loop fasteners of third components 112 of sock 102 may interconnect and sit flush against one another. In some embodiments where third components 112 include hook fasteners, as discussed above, second shoe insert 106 may include loop fasteners rather than hook fasteners such that sock 102 and second shoe insert 106 may still interconnect and sit flush against one another.

Second shoe insert 106 may be configured for use in a variety of shoe types, including lower backed shoes (e.g., sneakers) or higher backed shoes (e.g., boots). It will be appreciated by those of skill in the pertinent art that the placement of third components 112 on sock 102, and the complementary placement of second shoe insert 106 along the inside of a shoe, may depend on the type of shoe being worn. For example, when being used in conjunction with higher backed shoes, third components 112 may be disposed higher up along the back of a taller sock 102, such as between one's ankle and calf, while second shoe insert 106 may be placed farther up along the inside of the shoe. Second shoe insert 106 and complementary third components 112 disposed on sock 102 may help to provide additional support to help keep shoes and socks 102 interconnected such that shoes will not easily fall off one's feet.

While certain implementations of the disclosed technology have been described in connection with what is presently considered to be the most practical and various implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain implementations of the disclosed technology and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

As used herein, the terms "about" or "approximately" for any numerical values or ranges indicate a suitable dimensional tolerance that allows the part or collection of components to function for its intended purpose as described herein. More specifically, "about" or "approximately" may refer to the range of values ±20% of the recited value, e.g. "about 90%" may refer to the range of values from 71% to 99%.

In describing example embodiments, terminology has been resorted to for the sake of clarity. It is intended that each term contemplates its broadest meaning as understood by those skilled in the art and includes all technical equivalents that operate in a similar manner to accomplish a similar purpose without departing from the scope and spirit of the invention. It is also to be understood that the mention of one or more steps of a method does not preclude the presence of additional method steps or intervening method steps between those steps expressly identified. Similarly, some steps of a method can be performed in a different order than those described herein without departing from the scope of the disclosed technology. For clarity and conciseness, not all possible combinations have been listed, and such variants are often apparent to those of skill in the art and are intended to be within the scope of the claims which follow.

The invention claimed is:

1. A no-slip sock construction for placement inside a shoe, the no-slip sock construction comprising:

a sock configured to be worn on a foot of a person when the foot is positioned inside the shoe, the sock comprising:

one or more first components positioned on an outside bottom surface of the sock, wherein the one or more first components are silicone; and one or more second components positioned on the outside bottom surface of the sock, each of the one or more second components comprising one or more loop fasteners; and a shoe insert having a first thickness and configured to be placed inside the shoe, the shoe insert comprising:

one or more hook fasteners configured to interconnect with the one or more loop fasteners; and one or more openings having a second thickness and configured to slidably receive at least a portion of the one or more first components, wherein the first thickness of the shoe insert is greater than the second thickness of the one or more openings such that the one or more openings do not extend through the entire first thickness of the shoe insert.

2. The no-slip sock construction of claim 1, wherein each of the one or more first components has a thickness of about 0.25 to about 0.5 inches.

3. The no-slip sock construction of claim 1, wherein each of the one or more first components comprises a circular shape.

4. The no-slip sock construction of claim 1, wherein each of the one or more second components comprises a square shape.

5. The no-slip sock construction of claim 1, wherein the one or more first components extend farther out from the outside bottom surface of the sock compared to the one or more second components.

6. The no-slip sock construction of claim 1, wherein the one or more first components and the one or more second components are positioned in an alternating pattern.

7. The no-slip sock construction of claim 6, wherein the alternating pattern is positioned along a ball and a heel of the outside bottom surface of the sock.

8. The no-slip sock construction of claim 1, wherein the shoe insert is removeable.

9. The no-slip sock construction of claim 1, wherein the sock and the shoe insert are configured to sit flush against one another.

10. The no-slip sock construction of claim 1, wherein the one or more hook fasteners are disposed on the entire top surface of the shoe insert except for a respective location of each of the one or more openings.

11. The no-slip sock construction of claim 1, wherein the shoe insert further comprises an adhesive backing on a bottom surface of the shoe insert, the adhesive backing configured to adhere to an insole of the shoe.

12. A no-slip sock construction for placement inside a shoe, the no-slip sock construction comprising:

a sock configured to be worn on a foot of a person when the foot is positioned inside the shoe, the sock comprising:

one or more first components positioned on an outside bottom surface of the sock, where the one or more first components are silicone; and one or more second components positioned on the outside bottom surface of the sock, each of the one or more second components comprising one or more loop fasteners; and a removable shoe insert having a first thickness and configured to be placed inside the shoe, the removeable shoe insert comprising:

one or more hook fasteners configured to interconnect with the one or more loop fasteners; and one or more openings having a second thickness and configured to slidably receive at least a portion of the one or more first components;

wherein the one or more first components extend farther out from the outside bottom surface of the sock compared to the one or more second components;

wherein the one or more first components and the one or more second components are positioned in an alternating pattern; and wherein the first thickness of the removable shoe insert is greater than the second thickness of the one or more openings such that the one or more openings do not extend through the entire first thickness of the removable shoe insert.

13. The no-slip sock construction of claim 12, wherein each of the one or more first components has a thickness of about 0.25 to about 0.5 inches.

14. The no-slip sock construction of claim 12, wherein each of the one or more first components comprises a circular shape.

15. The no-slip sock construction of claim 12, wherein each of the one or more second components comprises a square shape.

16. The no-slip sock construction of claim 12, wherein the alternating pattern is positioned along a ball and a heel of the outside bottom surface of the sock.

17. The no-slip sock construction of claim 12, wherein the sock and the removeable shoe insert are configured to sit flush against one another.

18. A no-slip sock construction for placement inside a shoe, the no-slip sock construction comprising:

a sock configured to be worn on a foot of a person when the foot is positioned inside the shoe, the sock comprising:

one or more first components positioned on a first outside surface of the sock;

one or more second components positioned on a second outside surface of the sock, wherein each of the one or more first and second components comprising one or more loop fasteners; and one or more third components positioned on the first outside surface of the sock, wherein the one or more third components are silicone;

a first shoe insert having a first thickness and configured to be placed inside the shoe, the first shoe insert comprising:

one or more first hook fasteners configured to interconnect with the one or more loop fasteners of the one or more first components; and one or more openings having a second thickness and configured to receive the one or more third components, wherein the first thickness of the first shoe insert is greater than the second thickness of the one or more openings such that the one or more openings do not extend through the entire first thickness of the first shoe insert; and a second shoe insert configured to be placed inside the shoe and comprising one or more second hook fasteners configured to interconnect with the one or more loop fasteners of the one or more second components.

19. The no-slip sock construction of claim 18, wherein:

the first outside surface of the sock comprises a bottom outside surface of the sock, and the second outside surface of the sock comprises a back outside surface of the sock.

20. The no-slip sock construction of claim 18, wherein:

the first shoe insert is configured to engage with an insole of a shoe, and the second shoe insert is configured to engage with an inside heel portion of the shoe.

* * * * *